US009700155B1

(12) United States Patent
Theisen et al.

(10) Patent No.: US 9,700,155 B1
(45) Date of Patent: Jul. 11, 2017

(54) MULTI-FUNCTIONAL DISPLAY ASSEMBLY

(71) Applicant: Target Brands, Inc., Minneapolis, MN (US)

(72) Inventors: Jennifer A. Theisen, Crystal, MN (US); Alex K. Poniatowski, Brooklyn Park, MN (US); Glenn M. Christoffel, Jamesville, NY (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/993,459

(22) Filed: Jan. 12, 2016

(51) Int. Cl.

| | |
|---|---|
| ***A47F 3/14*** | (2006.01) |
| ***G09F 5/00*** | (2006.01) |
| ***A47F 7/28*** | (2006.01) |
| ***A45D 40/00*** | (2006.01) |
| ***A47F 5/00*** | (2006.01) |
| ***A47F 7/00*** | (2006.01) |
| *A47F 3/12* | (2006.01) |

(52) U.S. Cl.
CPC ..... *A47F 3/145* (2013.01); *A45D 40/0087* (2013.01); *A47F 5/0025* (2013.01); *A47F 5/0062* (2013.01); *A47F 7/0028* (2013.01); *A47F 7/286* (2013.01); *G09F 5/00* (2013.01); *A47F 3/12* (2013.01); *A47F 5/0018* (2013.01)

(58) Field of Classification Search
CPC ..... A47F 3/145; A47F 5/0025; A47F 5/0062; A47F 3/14; A47F 7/0028; A47F 7/286; A47F 5/0018; A47F 3/12; A45D 40/0087; G09F 5/00; G09F 3/204; G09F 23/06
USPC ..... 211/153, 85.26, 134, 88.01; 362/125; 206/564, 776
See application file for complete search history.

(56) References Cited

U.S. PATENT DOCUMENTS

| | | | | | |
|---|---|---|---|---|---|
| 2,681,262 | A | | 6/1954 | Vincent | |
| 3,416,655 | A | * | 12/1968 | Jerome | A45C 11/16 206/45.24 |
| 3,604,566 | A | * | 9/1971 | Rem | B65D 25/108 211/74 |
| 3,822,781 | A | * | 7/1974 | Braginetz | A45D 27/22 206/228 |
| 4,146,128 | A | * | 3/1979 | Hogg | B65D 5/5088 206/318 |
| 4,304,330 | A | * | 12/1981 | Winkler | A45C 11/34 206/214 |
| 4,361,226 | A | * | 11/1982 | Travis | B65D 5/4204 206/564 |

(Continued)

*Primary Examiner* — Daniel J Troy
*Assistant Examiner* — Hiwot Tefera
(74) *Attorney, Agent, or Firm* — Leanne Taveggia Farrell; Westman, Champlin & Koehler, P.A.

(57) ABSTRACT

A multi-functional display assembly includes a base tray secured to a display shelf and having a front, a back, a right side, a left side, a bottom, an open top and a height. At least one product plate assembly is positioned within the base tray and has a recess for holding a sample product. A transparent cover includes a height that is greater than the height of the base tray and greater than a height of the sample product. The transparent cover is placed over and around the base tray and is secured to the base tray and the at least one product plate assembly when the multi-functional display assembly is in a secured display configuration and is removed from around the base tray when the multi-functional display assembly is in an unsecured display configuration.

17 Claims, 7 Drawing Sheets

(56) References Cited

U.S. PATENT DOCUMENTS 4,733,827 A * 3/1988 Williams ..... A47J 43/07 206/373
4,739,353 A * 4/1988 Heuer ..... B65D 85/38 206/316.1
5,082,110 A * 1/1992 Hager ..... A63B 47/00 206/232
5,141,117 A 8/1992 Olsen et al.
5,312,000 A * 5/1994 Bass ..... A47F 7/286 211/4
5,358,101 A * 10/1994 Lombardi ..... B65D 25/101 206/485
5,377,820 A * 1/1995 Christman ..... A47F 5/0807 206/495
5,456,360 A * 10/1995 Griffin ..... B01L 9/06 206/443
6,321,475 B1 * 11/2001 Glanz ..... A47F 5/0068 248/220.41
6,883,671 B2 4/2005 Rushing
6,929,116 B2 8/2005 Chao et al.
6,955,261 B2 * 10/2005 Ploix ..... A45D 44/005 206/388
7,007,814 B2 3/2006 Ploix
7,310,222 B2 * 12/2007 Bovio ..... G06F 1/1616 211/169
7,356,955 B2 * 4/2008 Dombrowski ..... G09F 15/00 40/611.01
7,665,860 B2 2/2010 Demarest et al.
7,832,888 B2 11/2010 Demarest et al.
8,046,945 B2 * 11/2011 Radcliffe ..... A47G 1/06 40/737
8,256,628 B2 9/2012 Stafford et al.
8,413,807 B2 * 4/2013 Weldon ..... A47G 33/004 206/315.9
8,579,125 B2 11/2013 Trinh et al.
8,607,997 B2 12/2013 Bergdoll et al.
8,763,819 B2 7/2014 Theisen et al.
8,967,400 B1 3/2015 Mumford et al.
2004/0010954 A1 * 1/2004 O'Brien ..... A47F 7/024 40/724
2004/0064992 A1 * 4/2004 Borys ..... G09F 5/00 40/642.02
2005/0029159 A1 * 2/2005 Freeman ..... A47F 5/01 206/736
2005/0279579 A1 12/2005 Milk et al.
2006/0266672 A1 * 11/2006 Young ..... B65D 77/0433 206/776
2006/0278589 A1 12/2006 Peponis et al.
2007/0181515 A1 8/2007 Levi et al.
2007/0193922 A1 * 8/2007 Bacon ..... B65D 5/4204 206/776
2007/0236111 A1 * 10/2007 Gray ..... A47B 96/02 312/138.1
2007/0272634 A1 11/2007 Richter et al.
2008/0121563 A1 5/2008 Polvere et al.
2009/0294392 A1 * 12/2009 Stafford ..... A47F 5/0025 211/153
2013/0192106 A1 8/2013 Meyer-Hanover et al.
2013/0213911 A1 * 8/2013 Theisen ..... A47F 5/0025 211/59.4
2013/0220853 A1 * 8/2013 Weldon ..... A47G 33/004 206/315.9
2014/0238947 A1 8/2014 Hao
2015/0076093 A1 3/2015 Theisen et al.
2015/0144519 A1 * 5/2015 Tapper ..... A47F 7/0021 206/486
2015/0144581 A1 5/2015 Ports et al.

* cited by examiner

MULTI-FUNCTIONAL DISPLAY ASSEMBLY

BACKGROUND

Retail stores use a variety of display fixtures to present products to customers for purchase. These display fixtures can support the product, indicate the product price, include signage for highlighting the product and/or include structures that hold samples of the product for testing. Exemplary display structures include shelves, trays, racks, peg hooks and other similar structures.

The discussion above is merely provided for general background information and is not intended to be used as an aid in determining the scope of the claimed subject matter.

SUMMARY

A multi-functional display assembly includes a base tray, at least one product plate assembly and a transparent cover. The base tray is secured to a display shelf and includes a front, a back, a right side, a left side, a bottom, an open top and a height. The at least one product plate assembly is positioned within the base tray and has a recess for holding a sample product. The transparent cover includes a height that is greater than the height of the base tray and greater than a height of the sample product. The transparent cover is placed over and around the base tray and is secured to the base tray and the at least one product plate assembly when the multi-functional display assembly is in a secured display configuration and is removed from around the base tray when the multi-functional display assembly is in an unsecured display configuration.

A multi-functional display assembly includes a riser tray and at least one puck assembly. The riser tray is supported by a display shelf and includes a front, a back, a right side, a left side, a bottom and an open top. The at least one puck assembly is secured between the front and the back and the right side and the left side of the riser tray. Each puck assembly has a recess for holding a sample product. In a first display configuration, a sample product is placed in the recess of each puck assembly so as to be viewed and handled for testing. In a second display configuration, a sample product is placed in the recess of each puck assembly and a transparent vitrine including a front, a back, a right side, a left side and an open bottom is placed over and around the riser tray and the sample product and is secured to the riser tray and the at least one puck assembly so the sample product can be viewed but not handled for testing.

A method of configuring a multi-functional display assembly is also provided. The method includes configuring a multi-functional display assembly having a riser tray coupled to a display shelf and at least one puck assembly located in the riser tray that has a recess into a first display configuration by: positioning a sample product in the recess of each puck assembly so that the sample product is viewable and testable. The method further includes configuring the multi-functional display assembly into a second display configuration by: placing a transparent vitrine over and around the riser tray and the sample product; and securing the transparent vitrine to the riser tray and the at least one puck assembly so the sample product is viewable but not testable.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A multi-functional display assembly is described herein that supports sample products, such as expensive cosmetic bottles filled with lotions, creams and serums, in a retail store. The multi-functional display assembly supports and displays sample products in an attractive manner that is easy and convenient for customers to view in one configuration and to view and access in another configuration. In a first or unsecured display configuration, sample products can be viewed and accessed for testing. In a second or secured display configuration, sample products can only be viewed. The unsecured display configuration is configured for use in low-theft stores where sample products are not commonly stolen. The secured display configuration is configured for use in high-theft stores where sample products are commonly stolen.

Figure 1:
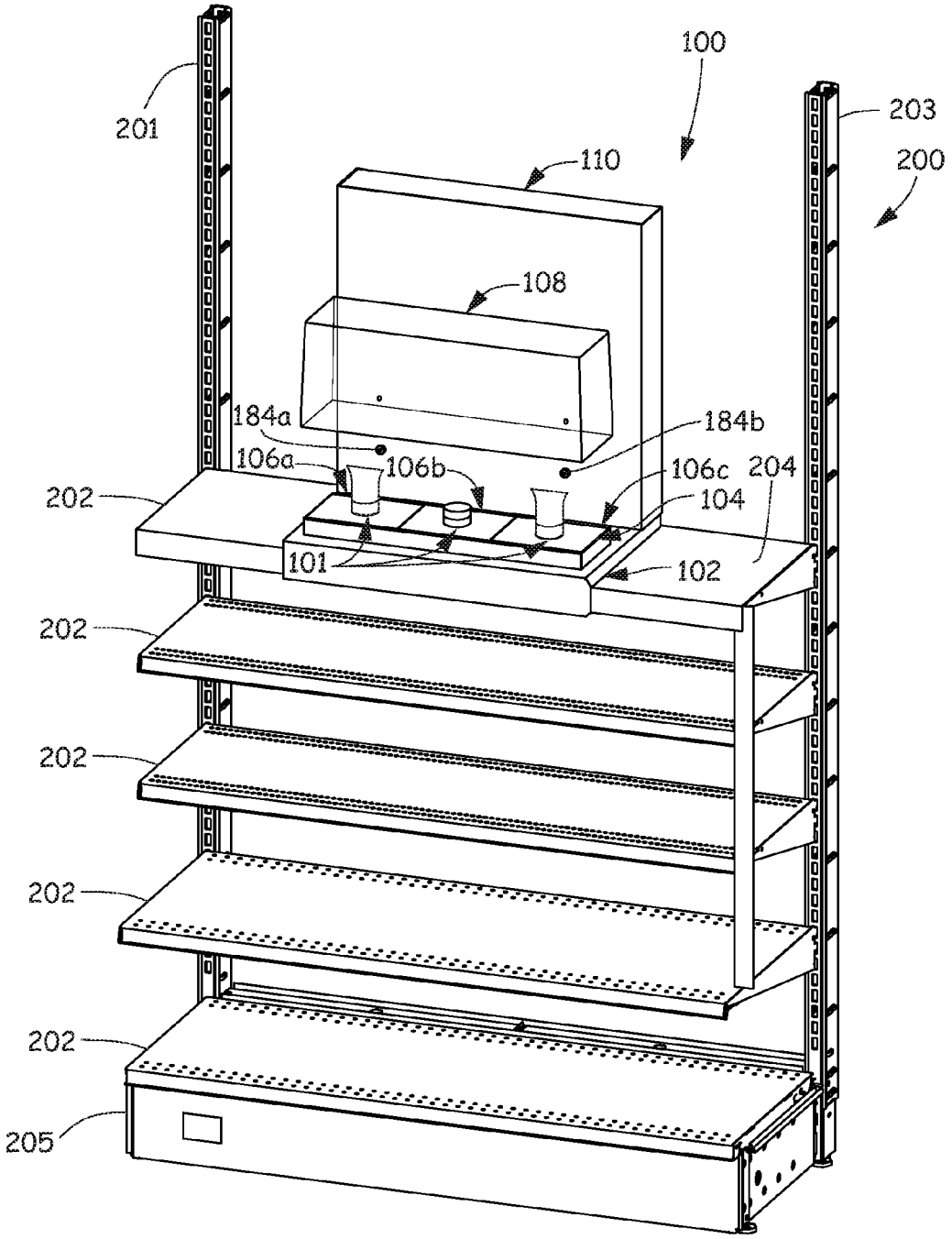
FIG. 1 is a partially exploded perspective view of a multi-functional display assembly located on a display shelf of a gondola display unit for displaying sample product according to one embodiment.

FIG. 1 is a partially exploded perspective view of a multi-functional display assembly 100 located on and secured to a display shelf 202 of a gondola display unit 200 for displaying sample products 101 according to one embodiment. As illustrated, display assembly 100 sits on a shelf cover 204 that covers display shelf 202. Gondola display unit 200 includes a pair of uprights 201 and 203, a base deck 205 and a plurality of display shelves 202 of which one is mounted to base deck 205 and the others are mounted to uprights 201 and 203. Display assembly 100 includes a riser assembly 102, a riser or base tray 104, a plurality of puck or product plate assemblies 106*a*, 106*b* and 106*c*, a vitrine or cover 108, fasteners 184*a* and 184*b* and a light box assembly 110.

Figure 2:
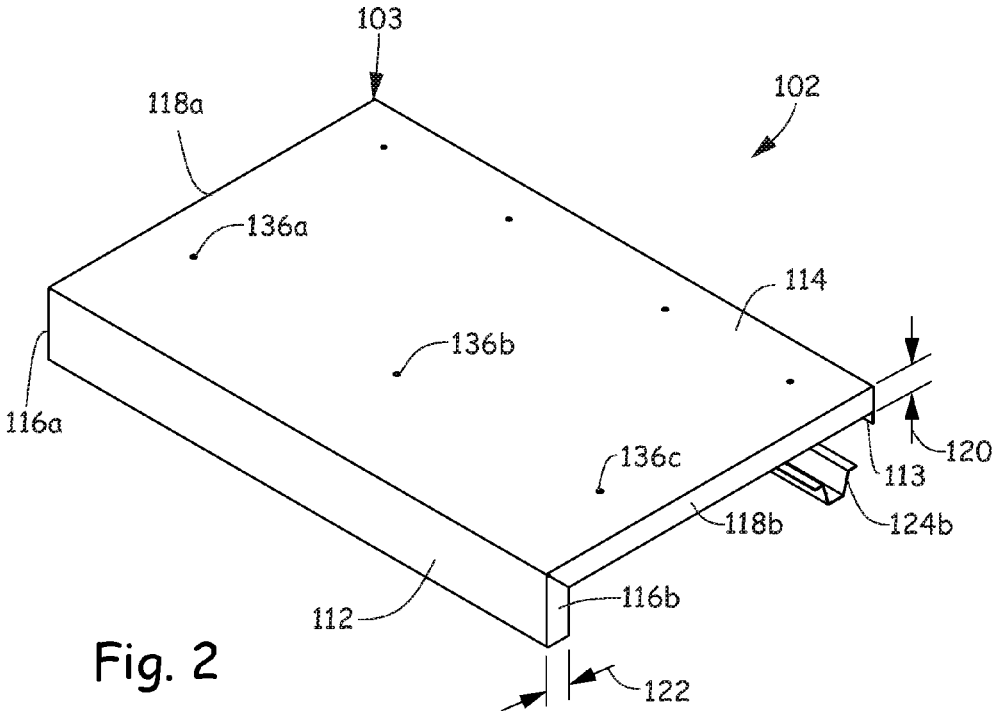
FIG. 2 is an exploded perspective view of a riser of the multi-functional display assembly illustrated in FIG. 1.

FIG. 2 is a partially exploded perspective view of riser assembly 102. In one embodiment and as illustrated, riser assembly 102 includes a riser 103 that is formed from a single piece of sheet metal. In other embodiments, riser 103 may be made from other types of single, continuous pieces of material that are bent to form certain structural features or may comprise multiple pieces of material welded or adhered together to form the structural features. In particular and in the embodiment shown, riser 103 includes a front panel 112 that is bent relative to a top panel 114 so that front panel 112 extends along a plane that is substantially perpendicular to the plane to which top panel 114 extends along. Further, the sides 116*a* and 116*b* of front panel 112 are bent relative to the front of front panel 112 and the sides 118*a* and 118*b* of top panel 114 are bent relative to the top of top panel 114. Sides 116*a*, 116*b*, 118*a* and 118*b* provide a height 120 to top panel 114 and a depth 122 to front panel 112. Height 120 raises structural features of display assembly 100 above the level of shelf 202 or shelf cover 204 on gondola display unit 200. Depth 122 brings front panel 112 forward and away from the front of display shelf 202. Riser assembly 102 further includes a pair of hat channels 124*a* (shown in FIG. 8) and 124*b* (illustrated exploded from a bottom surface of top panel 114 in FIG. 2) that are mounted to a bottom surface of top panel 114. Hat channels 124*a* and 124*b* provide structural stability to top panel 114.

Figure 3:
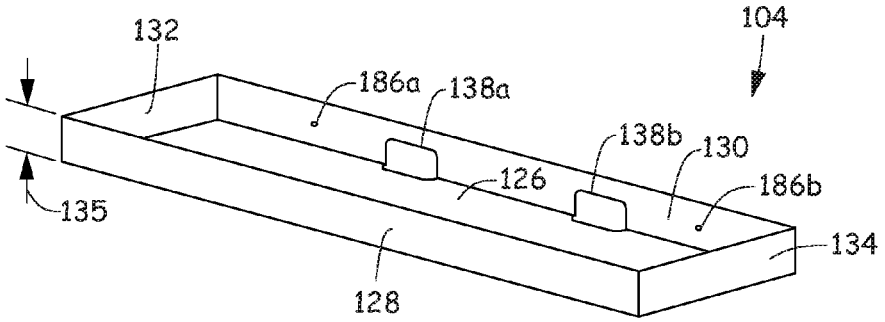
FIG. 3 is a perspective view of a riser tray of the multi-functional display assembly illustrated in FIG. 1.

FIG. 3 is a perspective view of riser tray 104. Riser tray 104 includes a bottom 126, a front 128, a back 130, a left side 132, a right side 134, an open top and a height 135. As illustrated in FIG. 1 and as will be discussed below, riser tray 104 sits on and is attached to top panel 114 of riser assembly 102. Three holes 136*a*, 136*b* and 136*c* in FIG. 2 that are closest to front panel 112 and corresponding holes (not shown) if bottom 126 of riser tray 104 receive fasteners 127 (FIG. 8) for fastening riser tray 104 to top panel 114 of riser assembly 103. Riser tray 104 further includes a pair of openings 138*a* and 138*b*. Openings 138*a* and 138*b* extend through a portion of back 130 and a portion of bottom 126 and will be discussed below in more detail.

Figure 4:
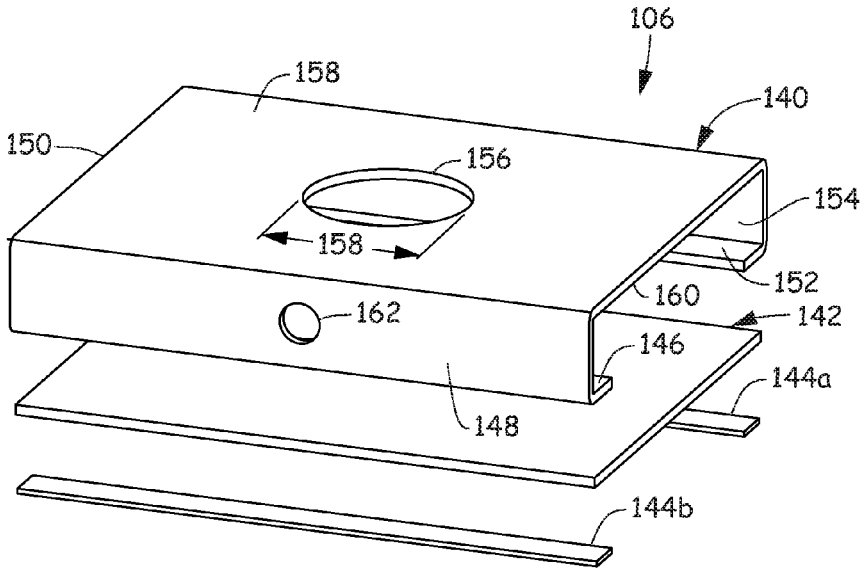
FIG. 4 is an exploded rear perspective view of a puck assembly of the multi-functional display assembly illustrated in FIG. 1.
Figure 5:
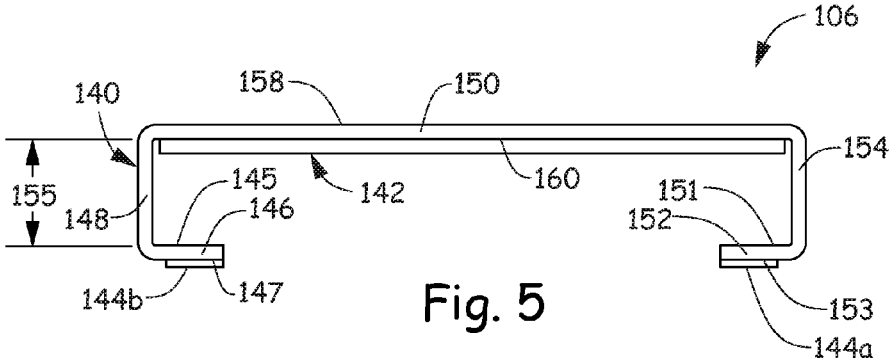
FIG. 5 is a left side view of the puck assembly illustrated in FIG. 4 as assembled.

FIG. 4 is an exploded rear perspective view of a puck or product plate assembly 106 that may be used as puck or product plate assembly 106*a*, 106*b* or 106*c* in the FIG. 1 embodiment. FIG. 5 is a left side view of puck assembly 106 as assembled. Puck assembly 106 includes an upper component 140, a support plate 142 and a pair of magnetic strips 144*a* and 144*b*.

In one embodiment and as illustrated, upper component 140 is formed from a single piece of acrylic. In other embodiments, upper component 140 may be made from a single, continuous piece of material that is bent to form certain structural features or may comprise multiple pieces of material welded or adhered together to form the structural features. In particular and in the embodiment shown, upper component 140 includes a back bottom panel 146 that is substantially perpendicular to a back panel 148. Back panel 148 is substantially perpendicular to a top panel 150 where top panel 150 is substantially parallel to back bottom panel 146. Top panel 150 includes a top surface 158 and an opposing bottom surface 160 and back bottom panel 146 includes a top surface 145 and an opposing bottom surface 147. Top surface 145 of back bottom panel 146 faces and is spaced apart from bottom surface 160 of top panel 150. Upper component 140 includes a front bottom panel 152 that is substantially perpendicular to a front panel 154. Front panel 154 is substantially perpendicular to top panel 150 where top panel 150 is substantially parallel to front bottom panel 152. Front bottom panel 152 includes a top surface 151 and an opposing bottom surface 153. Top surface 151 of front bottom panel 152 faces and is spaced apart from bottom surface 160 of top panel 150. The distance that top surface 145 is spaced apart from bottom surface 160 is substantially the same as the distance that top surface 151 is spaced apart from bottom surface 160. This substantially similar distance is denoted in FIG. 5 by dimension 155.

Top panel 150 of upper component 140 includes a geometrically-shaped through hole 156 that extends between top surface 158 of top panel 150 and bottom surface 160 of top panel 150 and is sized to match a sample product. For example, hole 156 is sized to match or be capable of receiving a bottom or top of a bottle or container that is to be displayed for viewing only or for viewing and handling as a test product. In the embodiment shown in FIG. 4, through hole 156 is in the shape of a circle having a diameter 158. Back panel 148 of upper component 140 also includes a through hole 162, which is discussed in detail below.

Support plate 142 in the illustrated embodiment is also made of a piece of acrylic. However, in other embodiments, support plate 142 can be made of other types of materials that can be welded or adhered to upper component 140. In the illustrated embodiment, support plate 142 is solvent bonded to bottom surface 160 of upper component 140 so that the geometrically-shaped through hole 156 is closed off and becomes a geometrically-shaped recess or indention 156 for receiving a bottom or top of a bottle or container of sample product, such as sample product 101. In other embodiments, support plate 142 can be welded or adhered to bottom surface 160 of upper component 140.

The pair of magnetic strips 144*a* and 144*b* in the illustrated embodiment are adhered to bottom surfaces 153 and 147. For example and as shown in the illustrated embodiment, magnetic strip 144*a* is adhered to bottom surface 153 of front bottom panel 152 by pressure sensitive adhesive tape and magnetic strip 144*b* is adhered to bottom surface 147 of back bottom panel 146 by pressure sensitive adhesive tape. When puck assembly 106 is assembled into multi-functional display assembly 100, puck assembly 106 fits within riser tray 104 and is magnetically coupled to bottom 126 of riser tray 104 with magnetic strips 144*a* and 144*b*.

Figure 6:
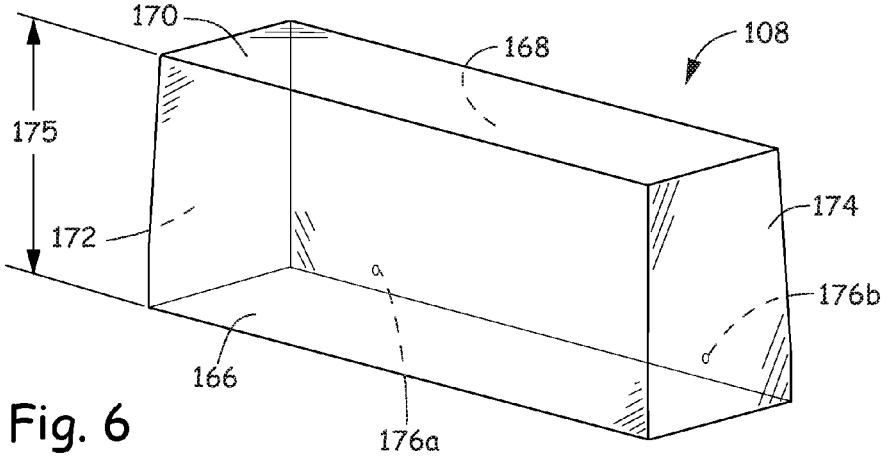
FIG. 6 is a perspective view of a vitrine of the multi-functional display assembly illustrated in FIG. 1.

FIG. 6 is a perspective view of vitrine or cover 108. Vitrine or cover 108 is made of a transparent material, such as styrene-acrylonitrile resin (SAN) or polystyrene. Vitrine 108 includes a front 166, a back 168, a top 170, a left side 172, a right side 174, an open bottom and a height 175. Height 175 is greater than height 155 of riser tray 104 and the heights of sample products 101 being supported by puck assemblies 106*a*, 106*b* and 106*c*. Back 168 includes a pair of holes 176*a* and 176*b*. Vitrine 108 is an optional component of multi-functional display assembly 100 and is securely mounted to riser tray 104 and at least one puck assembly 106 that fits within riser tray 104 in the case when multi-functional display assembly 100 supports tester products in a first display configuration where test products can only be viewed. Vitrine 108 will be discussed in more detail below.

Figure 7:
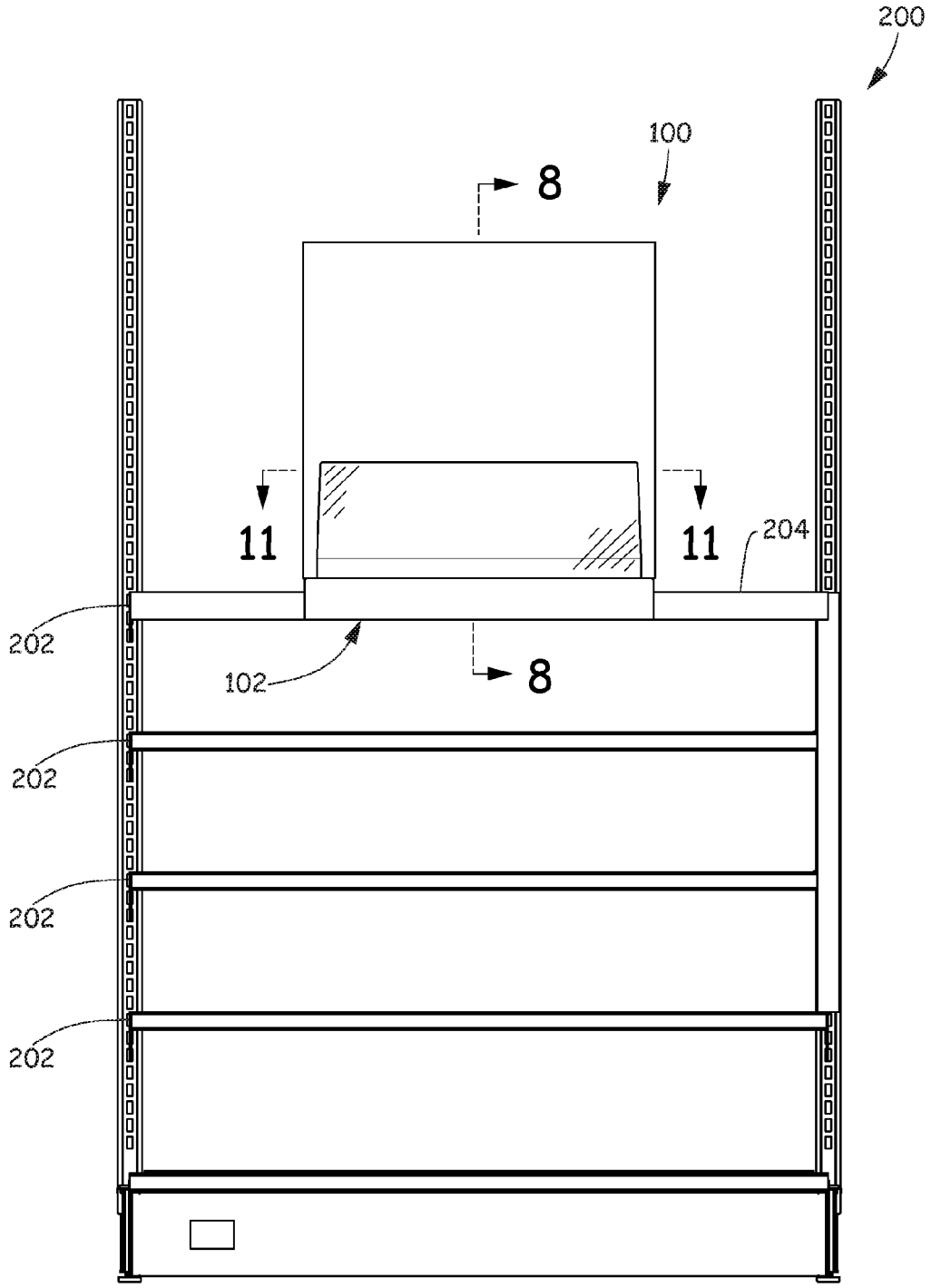
FIG. 7 is a front view of FIG. 1 with the vitrine assembled.
Figure 8:
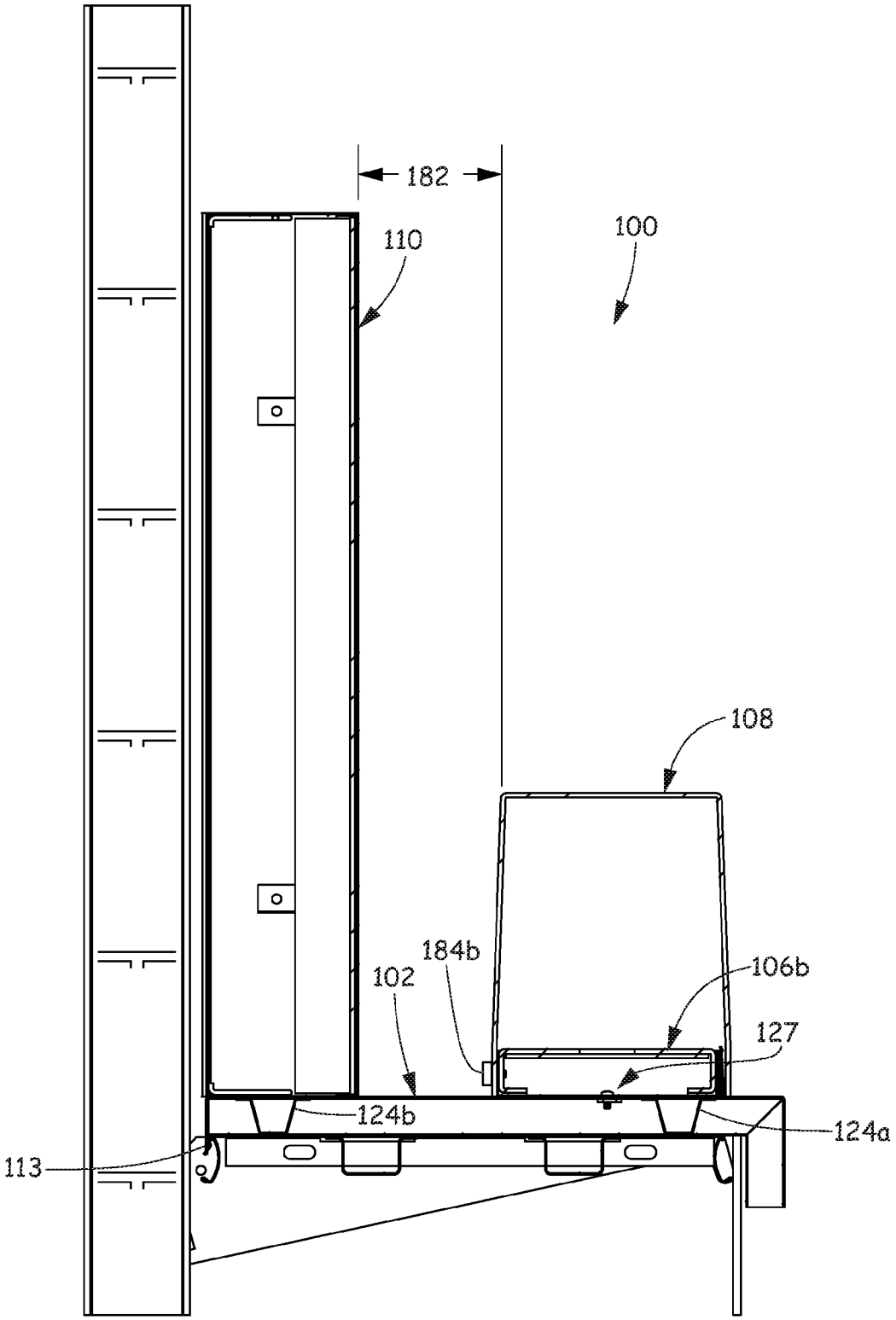
FIG. 8 is a section view of the multi-functional display assembly taken through line 8-8 in FIG. 7.
Figure 9:
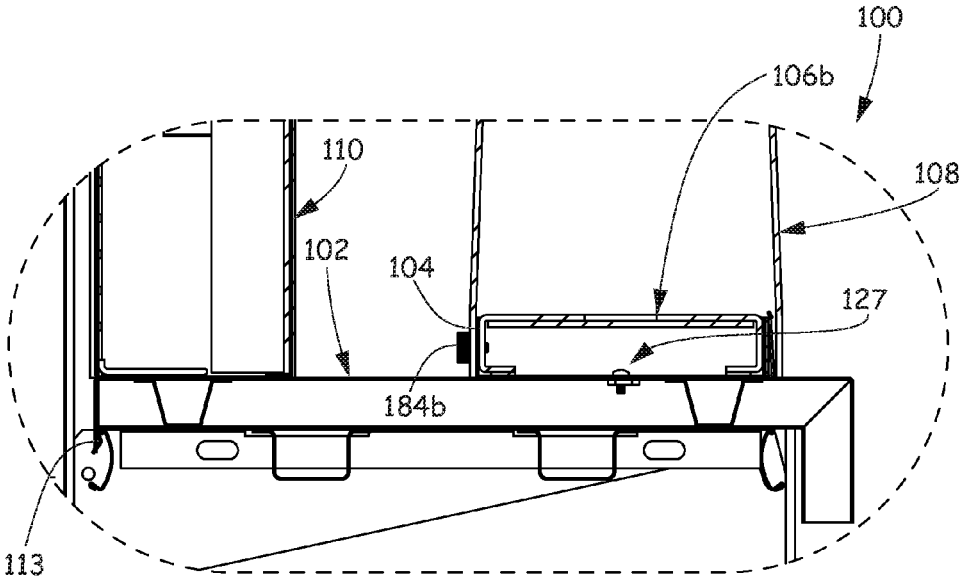
FIG. 9 is an enlarged view of a portion of FIG. 8.
Figure 10:
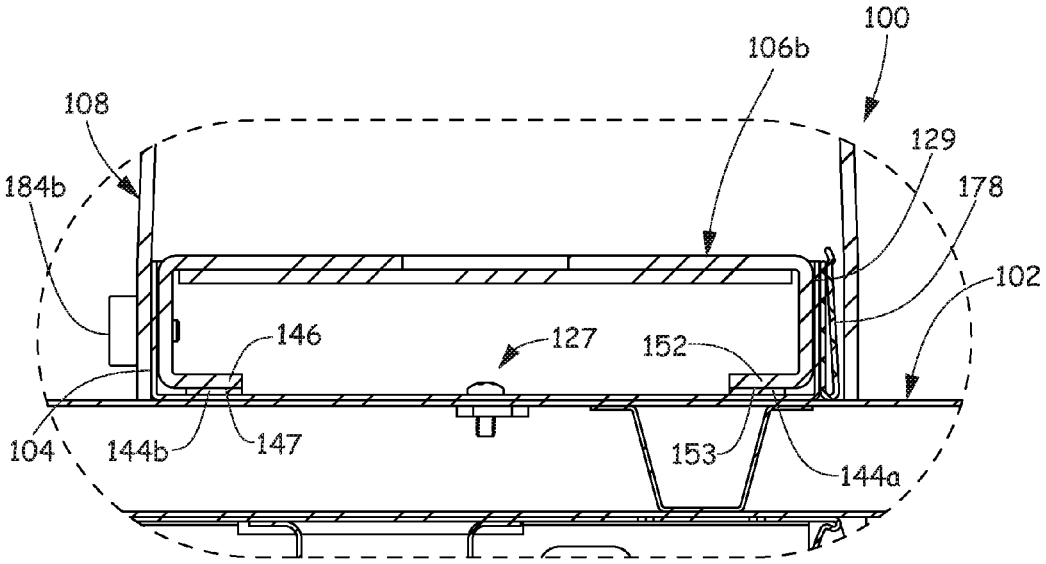
FIG. 10 is an enlarged view of a portion of FIG. 9.
Figure 11:
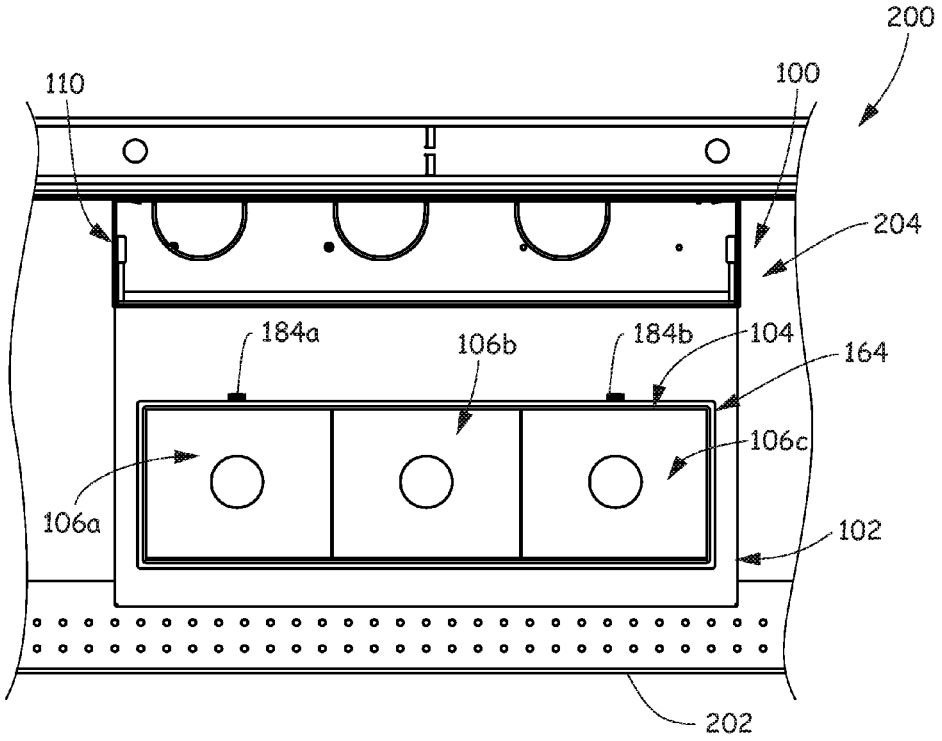
FIG. 11 is a section view of the multi-functional display assembly taken through line 11-11 in FIG. 7.

FIG. 7 is a front view of multi-functional display assembly 100 in the second or secured display configuration, FIG. 8 is a section view of multi-functional display unit 100 taken through line 8-8 in FIG. 7, FIG. 9 is an enlarged view of a portion of FIG. 8, FIG. 10 is an enlarged view of a portion of FIG. 9 and FIG. 11 is a section view of multi-functional display assembly 100 taken through line 11-11 in FIG. 7. FIGS. 1, 7, 8, 9, 10 and 11 illustrate how the components of multi-functional display assembly 100 fit together to display sample products in an attractive manner that is easy and convenient for customers to view in one display configuration and access and view in another display configuration.

Riser assembly 102 is mounted directly to a shelf 202 or, as in the illustrated embodiment, riser assembly 102 is mounted to shelf cover 204 that sits on a shelf 202. In one embodiment and as is shown in the illustrated embodiment in FIGS. 2 and 9, riser assembly 102 includes a back lip 113 that engages with the back of shelf 202 to hold riser assembly 102 in place. Height 120 of riser assembly 102 is provided to raise structural features of display assembly 100 above the level of shelf 202 or shelf cover 204 on gondola display unit 200, while depth 122 brings front panel 112 forward and away from the front of display shelf 202. Riser tray 104 is mounted to riser 103 and therefore is secured to display shelf 202 using the three holes 136*a*, 136*b* and 136*c* in top panel 114 of riser 103 and three holes in bottom 126 of riser tray 104 of which one fastener assembly 127 is threaded through the holes as illustrated in FIGS. 8-10. As a result, riser tray 104 is raised from the level of shelf 202 by height 120 of riser assembly 102.

A plurality of puck or product plate assemblies 106 are fitted, positioned or secured within riser tray 104. In FIGS. 1 and 7-11, three puck assemblies 106*a*, 106*b* and 106*c* are fitted within riser tray 104, however, any number of puck assemblies can be fitted in riser tray 104 by making each puck assembly smaller or larger in width or by making riser tray 104 smaller or larger in width. Generally, the number of puck assemblies 106 will coordinate with the number of sample products that need to be displayed. As illustrated in FIGS. 1 and 7-11, when placing puck assemblies 106 in riser tray, magnetic strips 144*a* and 144*b* mounted to bottom surfaces 153 and 147 of bottom front panel 152 and bottom back panel 146 magnetically couple to bottom 126 of riser tray 104. Each puck assembly 106 is arranged so that front panel 154 contacts front 128 of riser tray 104 and back panel 148 contacts back 130 of riser tray 104. In addition, the sides of each puck assembly are located adjacent to each other so that a left side of puck assembly 106*a* is in contact with left side 132 of riser tray 104 and a right side of puck assembly 106*c* is in contact with right side 134 of riser tray 104. In other words, each puck assembly 106 is secured between front 128 and back 130 and left side 132 and right side 134 of riser tray 104.

Since each puck assembly 106*a*, 106*b* and 106*c* is magnetically coupled to bottom 126 of riser tray 104, riser tray 104 provides openings 138*a* and 138*b* (introduced above) to access each puck assembly 106*a*, 106*b* and 106*c* for removal. In particular, each puck assembly 106*a*, 106*b* and 106*c* can be freed from its magnetic coupling by inserting one or more fingers through each of openings 138*a* and 138*b* to lift puck assembly 106*a*, 106*b* or 106*c* out by pushing on the bottom surfaces of each support plate 142 that is mounted to bottom surface 160 of upper component 140. These openings 138*a* and 138*b* puck assemblies 106*a*, 106*b* and 106*c* to be swapped out for puck assemblies having different sized components and different sized holes or recesses 156 for holding other sized sample products.

As illustrated in detail in FIG. 10, multi-functional display assembly 100 further includes a label holder 178 mounted or attached to front surface 129 of front 128 of riser tray 104 with, for example, adhesive, and receives at least one sign containing, for example, marketing information. Still further, multi-functional display assembly 100 includes a light box assembly 110. Light box assembly 110 illuminates a box that includes a marketing sign for display. Light box assembly 110 is placed behind riser tray 104 on top of riser assembly 102 and is spaced apart from riser tray 104 by a distance 182.

Riser assembly 102, riser tray 104, puck assemblies 106*a*, 106*b* and 106*c*, label holder 178 and light box assembly 110 complete a first or unsecured display configuration of multi-functional display assembly 100. In this first or unsecured display configuration, sample products can be held on puck assemblies 106*a*, 106*b* and 106*c* using recesses 156 and can be viewed and accessed or handled for testing by the customer because vitrine 108 has been removed. This first or unsecured display configuration of multi-functional display assembly 100 can be assembled as such in low-theft stores where sample products are not commonly stolen. In high-theft stores where sample products are commonly stolen, multi-functional display assembly 100 can be assembled into a second or secured display configuration as is shown in the embodiment illustrated in FIGS. 7-11. In the second or secured display configuration, multi-functional display assembly 100 includes all of the components of the first configuration, but in addition includes vitrine 108.

In the second display configuration, transparent vitrine or cover 108 is placed over and around the entirety of riser tray 104, puck assemblies 106*a*, 106*b* and 106*c* and label holder 178. Vitrine 108 is secured to riser tray 104 and at least one of puck assemblies 106 by using fasteners 184*a* and 184*b* (FIGS. 1, 8-11) so the sample products can be viewed but not handled. In particular, hole 162 of at least one of puck assemblies 106 aligns with one of the holes 186*a* and 186*b* in back 130 of riser tray 104, which aligns with one of the holes 176*a* and 176*b* in back 168 of vitrine 108. In this way, a fastener 184 can extend through vitrine 108, riser tray 104 and puck assembly 106 to form the second display configuration. As shown in the illustrated embodiment, fastener 184*a* extends through hole 176*a* in vitrine 164, through a corresponding hole 186*a* in back 130 of riser tray 104 and also through hole 162 in back panel 148 of puck assembly 106*a* and fastener 184*b* extends through hole 176*b* in vitrine 108, through a corresponding hole 186*b* in back 130 of riser tray 104 and also through hole 162 in back panel 148 of puck assembly 106*c*. Therefore, vitrine 108 is fixed to multiple components of multi-functional display assembly 100 so that a customer cannot lift vitrine 108 and take the sample product being displayed on puck assemblies 106*a*, 106*b* and 106*c*.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A multi-functional display assembly comprising:

a base tray secured to a display shelf and including a front, a back, a right side, a left side, a bottom, an open top and a height;

at least one product plate assembly positioned within the base tray and having a front panel, a back panel and a recess that is recessed from a top for holding a sample product; and a transparent cover having a height that is greater than the height of the base tray and greater than a height of the sample product, wherein the transparent cover is placed over and around the base tray and is secured to the base tray and the at least one product plate assembly when the multi-functional display assembly is in a secured display configuration and is removed from around the base tray when the multi-functional display is in an unsecured display configuration; and wherein the back panel of the at least one product plate assembly comprises a hole that aligns with a hole in the back of the base tray and a hole in a back of the transparent cover so that the hole in the at least one product plate assembly and the hole in the base tray and the hole in the transparent cover receive a fastener that secures the transparent cover to the base tray and to the at least one product plate assembly.

2. The multi-functional display assembly of claim 1, further comprising a riser assembly including a top panel and being mounted to the display shelf, wherein the top panel of the riser assembly is raised a height above the display shelf and the base tray is secured to the top panel of the riser assembly.

3. The multi-functional display assembly of claim 2, wherein the riser assembly further comprises a front panel that covers a front of the display shelf.

4. The multi-functional display assembly of claim 1, wherein the base tray includes at least one opening that extends through a portion of the back of the base tray and a portion of the bottom of the base tray so as to allow access for removing the at least one product plate assembly from the base tray.

5. The multi-functional display assembly of claim 1, further comprising a label holder attached to the front of the base tray and being located within the transparent cover when the transparent cover is placed over and around the base tray and the multi-functional display assembly is in the secured display configuration.

6. The multi-functional display assembly of claim 1, wherein the at least one product plate assembly comprises:

an upper component including a front bottom panel, the front panel, a top panel, the back panel and a back bottom panel, wherein the top panel includes a hole that extends between a top surface and a bottom surface of the top panel and the bottom surface of the top panel faces top surfaces of the front bottom panel and the back bottom panel; and a support plate coupled to the bottom surface of the top panel so that the hole is closed off and becomes the recess.

7. The multi-functional display assembly of claim 6, further comprising a first magnetic strip coupled to a bottom surface of the front bottom panel and a second magnetic strip coupled to a bottom surface of the back bottom panel, wherein the first and second magnetic strips magnetically couple the at least one product plate assembly to the bottom of the base tray.

8. A multi-functional display assembly comprising:

a riser tray supported by a display shelf and including a front, a back, a right side, a left side, a bottom and an open top; and at least one puck assembly secured between the front and the back and the right side and the left side of the riser tray, each puck assembly having a front panel, a back panel and a recess that is recessed from a top for holding a sample product;

wherein in a first display configuration a sample product is placed in the recess of each puck assembly so as to be viewed and handled for testing;

wherein in a second display configuration a sample product is placed in the recess of each puck assembly and a transparent vitrine including a front, a back, a right side, a left side and an open bottom is placed over and around the riser tray and the sample product and is secured to the riser tray and the at least one puck assembly so the sample product can be viewed but not handled for testing; and wherein the back panel of the at least one puck assembly comprises a hole that aligns with a hole in the back of the riser tray and a hole in a back of the transparent vitrine so that the hole in the at least one puck assembly and the hole in the riser tray and the hole in the transparent vitrine receive a fastener that secures the transparent vitrine to the riser tray and to the at least one puck assembly in the second display configuration.

9. The multi-functional display assembly of claim 8, further comprising a riser assembly having a top panel and being mounted to the display shelf, wherein a top of the top panel of the riser assembly is raised a height above the display shelf and the riser tray is secured to the top of the top panel of the riser assembly.

10. The multi-functional display assembly of claim 8, wherein the riser tray includes at least one opening that extends through a portion of the back of the riser tray and a portion of the bottom of the riser tray so as to allow access for removing the at least one puck assembly from the riser tray.

11. The multi-functional display assembly of claim 8, further comprising a label holder attached to the front of the riser tray and being located within the transparent vitrine when the transparent vitrine is placed over and around the riser tray and the sample product is in the second display configuration.

12. The multi-functional display assembly of claim 8, wherein the at least one puck assembly comprises:

an upper component including a front bottom panel, the front panel, a top panel, the back panel and a back bottom panel, wherein the top panel includes a hole that extends between a top surface and a bottom surface of the top panel and the bottom surface of the top panel faces top surfaces of the front bottom panel and the back bottom panel; and a support plate coupled to the bottom surface of the top panel so that the hole is closed off and becomes the recess.

13. The multi-functional display assembly of claim 12, further comprising a first magnetic strip coupled to a bottom surface of the front bottom panel and a second magnetic strip coupled to a bottom surface of the back bottom panel, wherein the first and second magnetic strips magnetically couple the at least one puck assembly to the bottom of the riser tray.

14. The multi-functional display assembly of claim 8, wherein the at least one puck assembly comprises a plurality of puck assemblies located adjacent to each other and within the riser tray.

15. The multi-functional display assembly of claim 8, further comprising a light box assembly located behind and spaced apart from the riser tray.

16. A method of configuring a multi-functional display assembly, the method comprising:

configuring a multi-functional display assembly having a riser tray coupled to a display shelf and at least one puck assembly located in the riser tray that has a recess into a first display configuration by positioning a sample product in the recess of each puck assembly so that the sample product is viewable and testable, wherein the at least one puck assembly includes a front panel, a back panel and the recess that is recessed from a top duct;

configuring the multi-functional display assembly into a second display configuration by placing a transparent vitrine over and around the riser tray and the sample product and securing the transparent vitrine to the riser tray and the at least one puck assembly so the sample product is viewable but not testable; and wherein securing the transparent vitrine to the riser tray and the at least one puck assembly comprises aligning a hole in the back panel of the at least one puck assembly with a hole in the back of the riser tray and a hole in a back of the transparent vitrine so that the hole in the at least one puck assembly and the hole in the riser tray and the hole in the transparent vitrine receive a fastener that secures the transparent vitrine to the riser tray and to the at least one puck assembly in the second display configuration.

17. The method of claim 16, wherein that at least one puck assembly located in the riser tray is magnetically coupled to the riser tray.

* * * * *